United States Patent [19]

Lee

[11] Patent Number: 5,018,376

[45] Date of Patent: May 28, 1991

[54] HIGH SECURITY AXIAL PIN TUMBLER LOCK

[76] Inventor: David G. Lee, 2200 E. Mettler Rd., Lodi, Calif. 94240

[21] Appl. No.: 495,328

[22] Filed: Mar. 19, 1990

Related U.S. Application Data

[63] Continuation-in-part of Ser. No. 328,889, Mar. 27, 1989, abandoned.

[51] Int. Cl.[5] ..... E05B 27/00

[52] U.S. Cl. ..... 70/491; 70/419

[58] Field of Search ..... 70/491, 492, 419, 376–378

[56] References Cited

U.S. PATENT DOCUMENTS

| | | | |
|---|---|---|---|
| Re. 28,319 | 1/1975 | Kerr . | |
| 2,292,515 | 8/1942 | George . | |
| 3,422,646 | 1/1969 | Monahan . | |
| 3,648,492 | 3/1972 | Walters | 70/491 |
| 3,693,384 | 9/1972 | Genakis | 70/419 X |
| 3,738,136 | 6/1973 | Falk . | |
| 3,756,049 | 9/1973 | Kerr . | |
| 3,808,854 | 5/1974 | Mercurio | 70/419 |
| 3,885,409 | 5/1975 | Genakis . | |
| 3,916,657 | 11/1975 | Steinbach . | |
| 4,041,739 | 8/1977 | Mercurio . | |
| 4,233,828 | 11/1980 | Davenbaugh | 70/491 |
| 4,446,709 | 5/1984 | Steinbach | 70/419 X |
| 4,507,945 | 4/1985 | Hwang | 70/491 |
| 4,621,510 | 11/1986 | Scherbing | 70/491 |
| 4,653,297 | 3/1987 | Moorhouse . | |
| 4,716,749 | 1/1988 | Johnson . | |
| 4,735,069 | 4/1988 | Steinbach | 70/491 |
| 4,802,354 | 2/1989 | Johnson . | |

*Primary Examiner*—Gary L. Smith
*Assistant Examiner*—Suzanne L. Dino
*Attorney, Agent, or Firm*—Leydig, Voit & Mayer

[57] ABSTRACT

An improved, highly pick-resistant axial pin tumbler lock construction incorporating a composite tumbler sleeve assembly made up of at least two limitedly rotatable or floating plates and the stationary tumbler sleeve portion which by virtue of providing a potential rotation as much as ½ the arcuate distance between pin bore centers of the floating plates provides false shear planes that preclude tight and loose feels when manipulating driver pins in an attempted picking operation. In the preferred embodiment at least one pin column has at least three pin segments and the floating plates are incorporated with the construction of Johnson U.S. Pat. No. 4,802,354 to provide the highest degree of pick resistance.

20 Claims, 5 Drawing Sheets

HIGH SECURITY AXIAL PIN TUMBLER LOCK

This application is a continuation-in-part of U.S. Ser. No. 07/328,889 filed Mar. 27, 1989.

BACKGROUND OF THE INVENTION

The present invention relates generally to axial pin tumbler locks and, more particularly, relates to an improved type of construction for axial pin tumbler locks which offers a further heightened degree of resistance to picking.

FIELD OF THE INVENTION

The well-known axial pin tumbler locks, are currently available in a large variety of structural arrangements and are frequently used in applications such as vending machines, which are installed in locations susceptible to picking attempts and other forms of surreptitious entry. Hence, it is a primary concern to design such tumbler locks in a fashion making them highly resistant to picking attempts.

Axial pin tumbler locks, for instance, are conventionally based upon a design including a tubular driver sleeve fixed to a locking spindle, which is rotatably mounted and is normally prevented from rotation by axially movable tumbler pins that extend between the driver sleeve and an adjacent rigidly anchored tumbler sleeve. The driver pins are usually of different lengths and, when actuated using a proper key, axially displace the tumbler pins through different predetermined distances in such a manner that all the tumbler pins are precisely aligned at the shear plane between the locking spindle sleeve and the tumbler sleeve, thereby permitting the locking spindle and sleeve to turn and bring about the unlocking action.

Although the use of several pins of different lengths provides such conventional tumbler locks with reasonable pick-resistant qualities, these locks can be picked by the use of small, specially shaped tools or probes that can be inserted into the keyway and used to manipulate the driver pins against corresponding tumbler pins so as to lock the driver pins against the tumbler pin sleeve edges due to the slight lateral movement or "give" available at the shear plane. This allows the locking spindle sleeve and hence the lock mechanism itself to rotate, thereby defeating the axial pin tumbler lock. Many conventional axial pin tumbler locks are also susceptible to decoding techniques in which thin elongated tools are used to move the tumbler pins so as to determine by feel the position of each tumbler pin when it is at the shear line or otherwise at the spindle-rotating position.

Some axial pin tumbler locks utilized grooves defined on the tumbler pins that bind with corresponding flanges defined internally on the cylinder sleeve body of the lock when picking is attempted. Such locks generally necessitate complicated design and construction of the cylindrical lock body internal elements. For instance, the Huck Pin lock from Builders Hardware Industries incorporates a series of lands and grooves around some of the lower portion of the top pins and the upper top portion of the some of the lower pins. These lands and grooves cause the pins to bind on a flange surrounding the lower portion of the cylinder pin housing when the lock is subjected to a picking attempt. (See Self et al., Technical Memorandum No. M-64-79-02, Naval Construction Battalion Center, California, pp. 11,12.)

Other attempts have been made to use multiple shear planes some of which are false by way of multiple pin segments, or plates fixed to the housing or a sleeve. Examples of such varying arrangements are shown in Genakis, U.S. Pat. No. 3,885,409, Moorehouse U.S. Pat. No. 4,653,297 and Johnson U.S. Pat. Nos. 4,716,749 and 4,802,354.

Lock pickers employ different techniques, but all of such techniques do have some common application principles. In any picking operation, a torque must be applied and held on the spindle. Since there is some play due to the tolerances between the pins and the bores within which the pins are located, pickers seek a feel of a pin column such as tightness or looseness which provides an indication of when there is some alignment at a shear line. In most if not all the lock constructions heretofore provided, the tightness in the pin column occurs only when the pin interfaces are not at a shear line. Whether the lock employs false as well as true shear lines in such locks, some feel of tightness and looseness provides the picker with the indications needed to open the lock by assisting with finding the right pin alignment with the true shear line.

SUMMARY OF THE INVENTION

It is the general aim of the present invention to provide an improved axial pin tumbler lock construction which is more highly resistant to picking attempts.

A related object is to provide an improved axial pin tumbler lock that is based on relatively simple additions to existing locking mechanisms and that can be economically manufactured for use even with presently produced locks. Specifically, the present invention lends itself to be mass produced in principle part by die casting or sintering.

It is a further object of this invention to provide an improved axial pin tumbler lock of the above type that is substantially of the same size and only adds a small number of mechanical components to existing axial pin tumbler locks having low manufacturing costs.

These and other objects of this invention are realized by providing a composite tumbler sleeve including a plurality of independently but limitedly rotatable plates between the front face of a stationary tumbler sleeve portion and the driver sleeve which creates false shear planes and a pin column "lock up" with multiple pin segments in at least some chambers when manipulated by the driver pins in an attempt to pick the lock. Intermediate pin segments are shorter in length than the thicknesses of at least two of such limitedly rotatable plates. Thus when attempting to pick the lock, if the interface between the driver, segmented, or tumbler pins is at any of the edges of the limitedly rotatable plate false shear planes, the pin column will be shut off from providing any further ability to manipulate the driver pin of that column.

The illustrative lock construction is uncomplicated and economical and can easily be incorporated into the design of the high security axial pin tumbler locks such as that of Johnson U.S. Pat. Nos. 4,716,749 and 4,802,354 which will provide a lock of the highest degree of pick resistance.

BRIEF DESCRIPTION OF THE DRAWINGS

The invention and further objects and advantages thereof will be made apparent by reference to the ensuing description when taken in conjunction with the accompanying drawings, wherein.

DESCRIPTION OF THE PREFERRED EMBODIMENT

Figure 1:
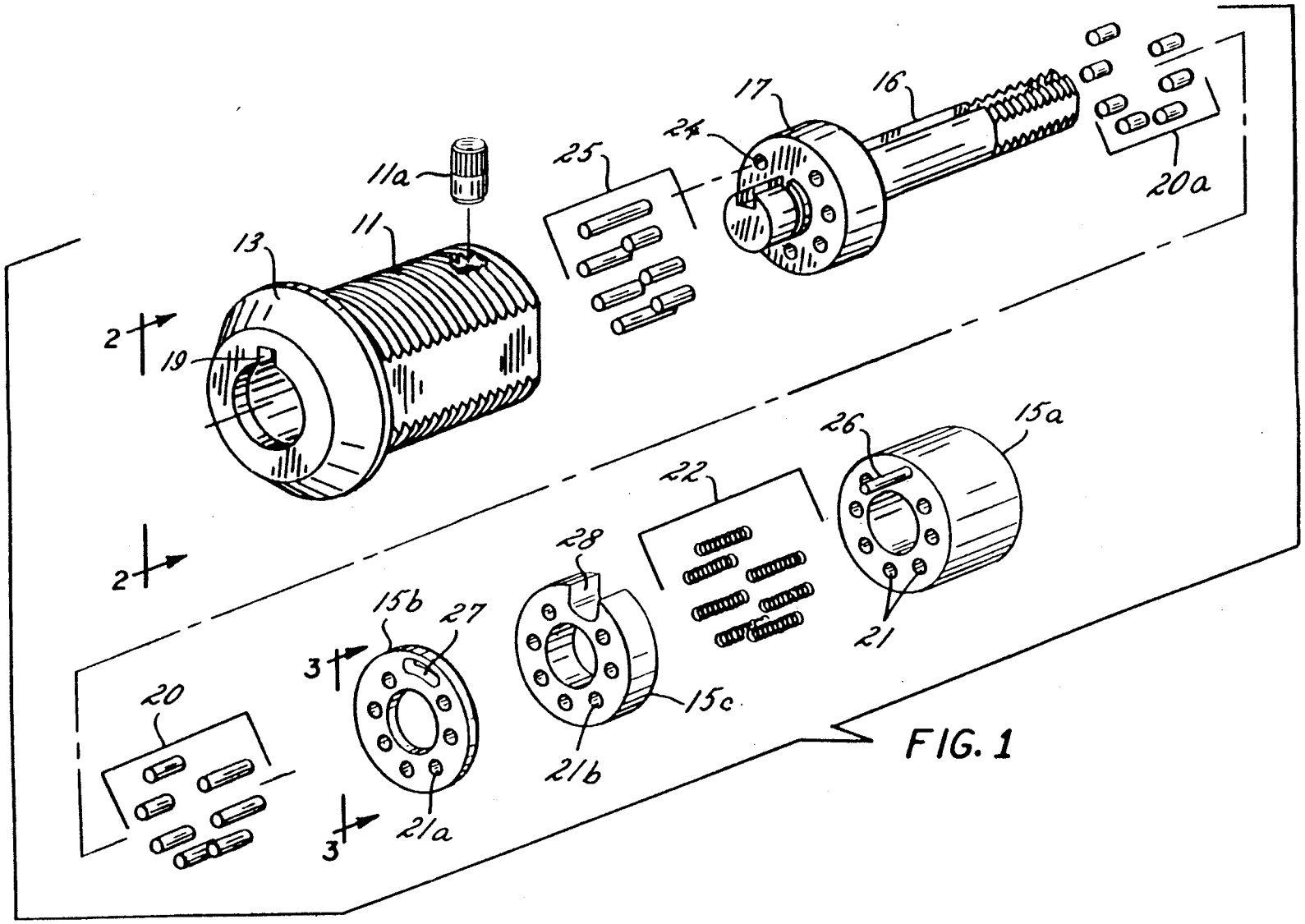
FIG. 1 is an exploded perspective view of certain important components of the tumbler lock according to one preferred embodiment of this invention.
Figure 2:
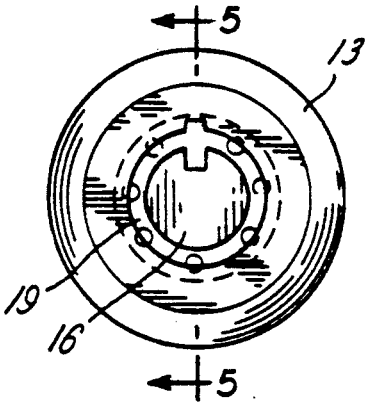
FIG. 2 is a front elevational view taken along the line 2—2 of FIG. 1 of the tubular axial pin tumbler lock constructed according to the preferred embodiment of the invention.
Figure 3:
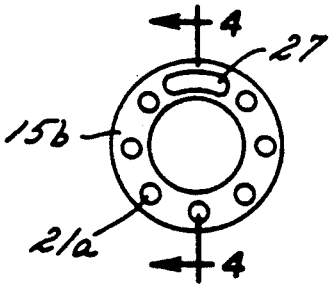
FIG. 3 is a front elevational view taken substantially along the line 3—3 of FIG. 1.
Figure 4:
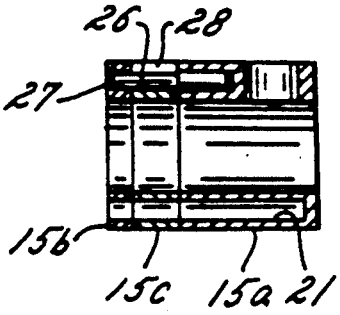
FIG. 4 is an isolated cross-sectional view taken along the line 4—4 in FIG. 3.
Figure 5:
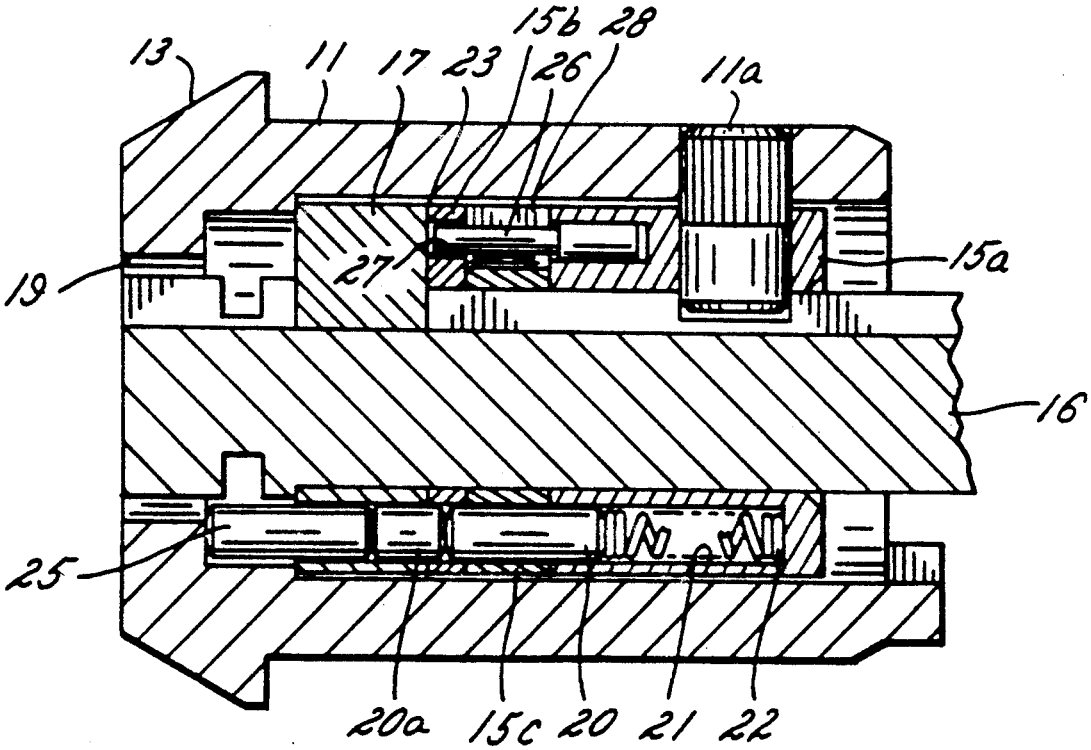
FIG. 5 is an enlarged cross-sectional view of a lock assembly of the present invention.

Referring collectively now to FIGS. 1 and 5, there is shown an axial pin tumbler lock construction in accordance with a preferred embodiment of this invention. The construction and operation of a conventional axial pin tumbler lock is first described by generally referring to the figures; the construction and operation of an axial pin tumbler lock incorporating the invention is then described with specific reference to the figures. The tumbler lock includes an outer tubular body 11, which is adapted to be threaded into a support member (not shown). The outer tubular body 11 includes a frustoconical head 13 that seats against the support member at the front face of the lock. A stationary tumbler sleeve portion 15*a* telescopes into and is rigidly anchored within the rear end of the tubular body 11 by a pin 11*a*. An elongated spindle 16 is rotatably supported in the tumbler sleeve portion 15*a* and extends through the lock body. A driver pin sleeve 17 is located at the forward end of the rotating spindle 16. A locking member (not shown) is fastened into position after being inserted through the cross-section of the rear end of the spindle 16.

Actual locking and unlocking action of the lock is brought about by the rotating motion of the spindle 16, which in turn causes the locking member to move between a locked and unlocked position. Rotational movement of the spindle 16 is normally effected by using a key (not shown) adapted to fit into the frustoconical head 13 over the spindle 16; a tab aligns the key in the keyway 19 provided in the head of the lock.

A series of annularly spaced tumbler pins 20 (FIGS. 1 and 5) are slidably positioned within bores 21 defined through the rearmost fixed tumbler sleeve portion 15*a* and function to normally retain the spindle 16 in its locked position wherein rotational motion is prohibited. The tumbler pins 20 are invariably urged forward by means of coiled compression springs 22 disposed within the bores 21 in which the pins are retained. Under the urging of the springs 22, the tumbler pins 20 are disposed along the bores 21 in such a manner that the outer ends of some pins normally project outward beyond the shear plane 23 formed at the interface adjacent the driver pin sleeve 17 (FIG. 5), and into corresponding bores 24 defined through the driver sleeve 17. In this normal position, the tumbler pins 20 lock the driver sleeve 17 and the spindle 16 against rotational motion relative to the fixed tumbler sleeve portion 15*a*.

However, such rotational motion is permitted if the tumbler pins 20 are displaced rearwardly against the urging of the compression springs 22 in such a fashion that the forward ends of all the tumbler pins 20 lie exactly at the shear plane 23. This rearward displacement of the tumbler pins 20 is effected by driver pins 25 positioned in an axially slidable manner within the bores 24 of the driver sleeve 17. The driver pins 25 are positioned such that the inner ends of the driver pins 25 engage with the outer ends of the corresponding tumbler pins 20. Generally, at least some of the driver pins 25 are of different lengths. In this way, alignment of all tumbler pins 20 at the shear plane 23 necessarily requires the displacement of different driver pins 25 by different predetermined distances. Use of a properly coded key will displace the driver pins 25 through the predetermined distances in order to cause the rear ends of all of the tumbler pins 20 to be simultaneously aligned at the shear plane 23 so that the spindle 16 may be rotated. Coding of such conventional tumbler locks is accomplished by placing driver pins 25 of different lengths inside predetermined ones of the bores 24 defined in the driver sleeve 17.

The tumbler lock described so far is fairly conventional and can be picked by inserting a thin flexible probe through one of the bores of the driver sleeve in order to push the driver pin disposed therein, and consequently the corresponding tumbler pin backward while simultaneously applying a slight twisting force to the driver spindle and feeling for the slight edge presented by the junction of the driver pin and the tumbler pin at the shear plane and then gently locking the driver pin in this position. Even if it is not possible to pick the lock by locking the driver pin at the shear plane, it is possible to decode the lock by estimating the length of a particular driver pin by carefully feeling for the edge or slight "give" resulting from the movement of the head of the driver pin in the immediate vicinity of the shear plane. The locking mechanism of such tumbler locks can hence be defeated by repeating the above procedure on the rest of the driver pins.

Increased resistance to such attempts at picking or decoding the locking mechanism is made possible by constructing the locking components in such a way that a series of false shear planes, and false feels or indications of the existence of the shear plane are provided as the driver pins are pushed backward in an attempt to pick the lock. Likewise, such false feels and false shear planes are provided if the attempt is made to "back pick" by pushing the pins all the way down and seeking to find the shear plane in the upward pin travel.

In accordance with the present invention there is provided a composite or segmented tumbler sleeve that is defined by a plurality of limitedly rotatable plates 15b, 15c and the fixed sleeve member, 15a. While it is preferred that there are at least two of the limitedly rotatable plates 15b, 15c, it will be appreciated that more of such plates may be added to further increase the resistance to picking attempts. Further, the plates 15b, 15c may be of different thicknesses, as shown in FIGS. 1 and 5.

As shown in FIGS. 1, 5, 10 and 11, the limitedly rotatable plates 15b, 15c are disposed between the driver pin sleeve 17 and the fixed sleeve portion 15a. Plate 15b has bores 21a and plate 15c has bores 21b, which are annularly spaced and correspond to the bores of the driver and stationary tumbler portion sleeves 17, 15a. The segmented tumbler sleeve (including segments 15a, 15b and 15c) is mounted so that it is independently rotatable with respect to the driver pin sleeve 17 at the line 23. In order to create false shear planes, the plates 15b, 15c are mounted such that they are limitedly rotatable between themselves and the stationary sleeve 15a. The degree to which the plates 15b, 15c may rotate is limited by a projection that extends from a segment 15a, 15b or 15c of the segmented tumbler sleeve through openings in the remaining segments. The openings through which the projection extends are generally elongated so that the segments are not rigidly fixed together, but, rather, they are permitted to rotate through an arc that is limited by the projection and the edges of the openings.

In the embodiment shown in FIGS. 1–5, a pin 26 is rigidly anchored in the fixed sleeve portion 15a and extends toward the front face of the lock through openings 27, 28 in the plates 15b, 15c. In order to provide limited rotational movement of the plates 15b, 15c, the openings 27, 28 may be of any shape that permits the pin 26 to slide within the openings 27, 28 as the plates 15b, 15c are rotated with respect to each other and with respect to the fixed sleeve portion 15a. An elongated bore 27 and a notch 28 are provided in plates 15b and 15c, respectively, in the embodiment shown. In this way, the plates 15b, 15c may rotate about the center axis of the lock as the bore 27 or notch 28 moves along the pin 26.

In the present instance, the invention also provides intermediate pin segments 20a, so that in the preferred form there are at least three pin segments in each aligned set of tumbler bores. The intermediate pin segments 20a can be of varying lengths, but the overall length of the intermediate pin segments should be at least slightly less than the total thickness of the limitedly rotatable plates 15b, 15c. It will be appreciated that the lock may be unlocked when the interfaces of the intermediate pin segments 20a and the driver pins 25 are located at the shear plane 23 between the driver pin sleeve 17 and the limitedly rotatable plate 15b.

Figure 6:
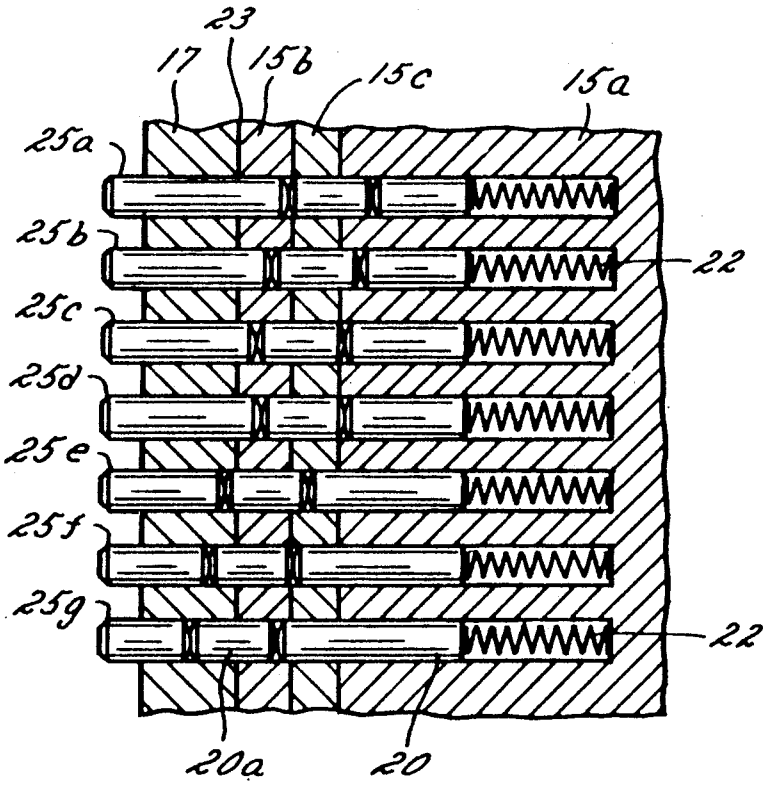
FIG. 6 is an enlarged cross-sectional isolated planar view of the plate areas between a driver and the corresponding tumbler sleeves and illustrating the false shear lines provided according to this invention.
Figure 7:
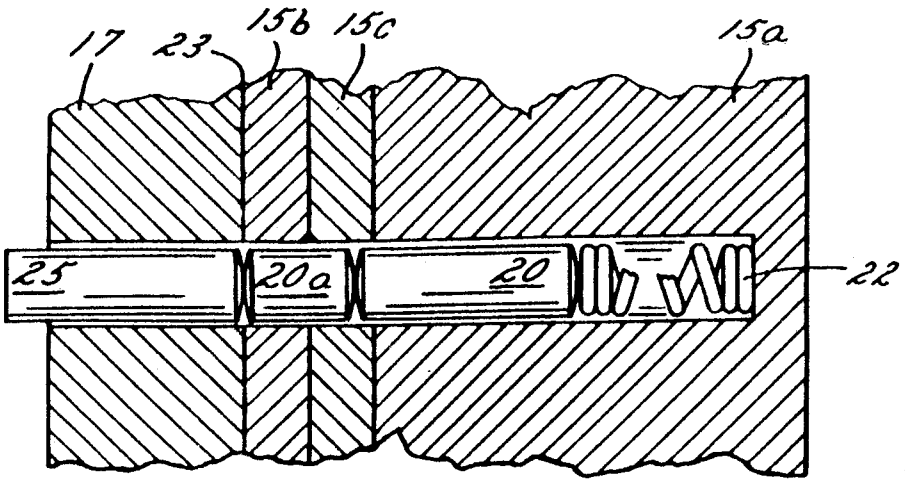
FIG. 7 is an enlarged cross-sectional view showing the proper alignment of a driver pin at the shear line for opening the lock.
Figure 8:
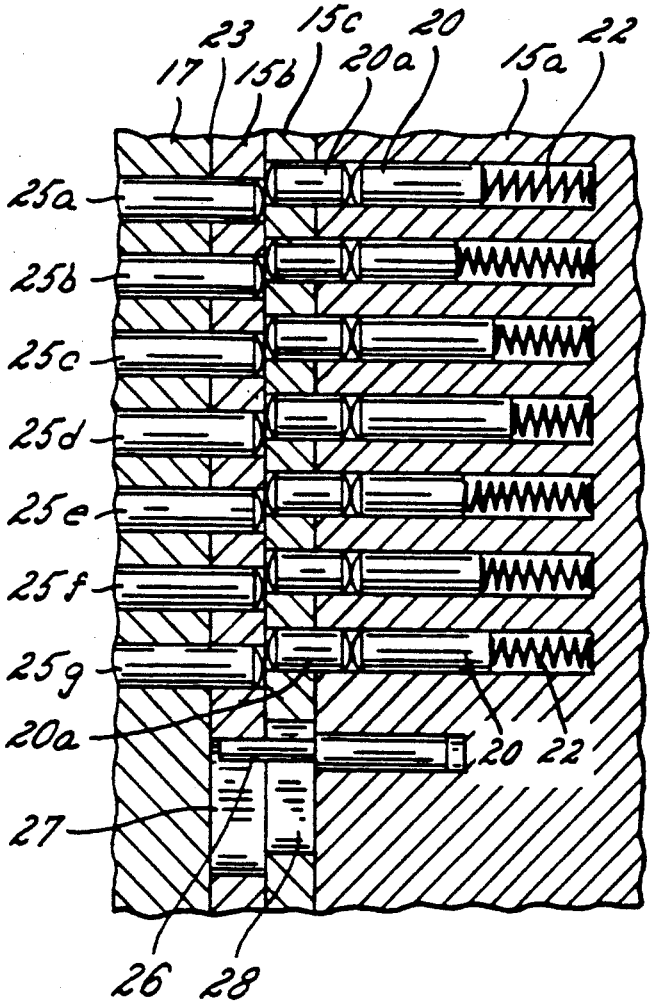
FIG. 8 is an enlarged cross-sectional isolated planar view of the plate areas between a driver and the corresponding tumbler sleeves and illustrating the limited rotation of the plates and driver sleeves, and the false shear lines created thereby.

While the limitedly rotatable plates 15b, 15c may be of different thicknesses, as shown in FIGS. 1 and 5, the plates 15b, 15c illustrated in FIGS. 6–8 are equal thicknesses. Referring first to FIG. 6, there is shown a typical example of a pin combination arrangement laid out in a planar illustrative view. In the figure, the driver pins 25a–25g all have their ends out of alignment with the shear plane 23, thus indicating a locked condition. Likewise, intermediate segments 20a and tumbler pins 20 have their ends disposed in various locations with respect to the interfaces of plates 15b and 15c, and plate 15a and stationary sleeve portion 15c.

FIG. 7 shows a single pin column with interface of the driver pin 25 and the pin segment 20a located along the shear plane 23. The driver pin 25 has been moved inwardly, such as by an appropriate key (not shown). Where all the pin columns in the lock are so disposed, the driver pin sleeve 17 would then be freely rotatable to open the lock.

In accordance with an important aspect of the invention, false shear planes that actually permit limited rotation of the driver pin sleeve 17 are provided. As the driver pin sleeve 17 and one or more of the plates 15b, 15c rotate through a limited arc, rotation along the false shear plane created between the plates 15b, 15c, or between the plate 15c and the stationary tumbler sleeve portion 15a results in a feel that is virtually identical to feel of rotation along the true shear plane 23. Such a rotation along the false shear planes results when the interfaces of the intermediate pin segments 20a and the driver pins 25 or the tumbler pins 20 coincide with the false shear plane.

FIG. 8 shows an example of a pin combination arrangement laid out in a planar illustrative view where the interfaces of the intermediate pin segments 20a and the tumbler pins 20 coincide with the false shear plane at the interface of the limitedly rotatable plates 15b, 15c, and an applied torque causes a downward shift in the driver pin sleeve 17. One skilled in the art will appreciate that, in the position shown, the relative rotation of the plates 15b, 15c is limited by the pin 26 extending from the tumbler sleeve 15a such that the plates 15b, 15c rotate through a limited range. As may be seen in FIG. 9, the plates 15b, 15c may potentially rotate as much as approximately one-half of the arcuate distance between the centers of the bore holes 21.

As the plates 15b, 15c rotate, the picker feels the substantial rotation at a false shear plane created at the interface between the plates 15b, 15c, which feels similar to the rotation when the pin segment 25, 20a interface is at the true shear plane 23. As a result, the feel of an unsuccessful picking attempt will be virtually identical to the feel of a potentially successful picking attempt. A picker senses the location of a shear plane as a column is effectively shut off when the pin interface 25, 20a, or 20a, 20 is at the false shear plane.

There are multiple opportunities for rotation of the false shear planes at the interfaces between the plates 15b, 15c, and plate 15c and the sleeve 15a because the invention provides at least one intermediate pin segments 20a in each set of pins 25, 20a, 20. Thus, the relationship of the intermediate segments 20a allows for the creation of multiple false shear planes. Consequently, a picker may believe that each pin interface 25, 20a or 20a, 20 is situated at the true shear plane 23, when in actuality the interfaces are situated at false shear planes, and the rotation of the elements of the segmented tumbler sleeve 15a, 15b, 15c is limited by the pin 26 so that the lock will not open. This results in a lock that is, for all intensive purposes, virtually pick proof.

Figure 9:
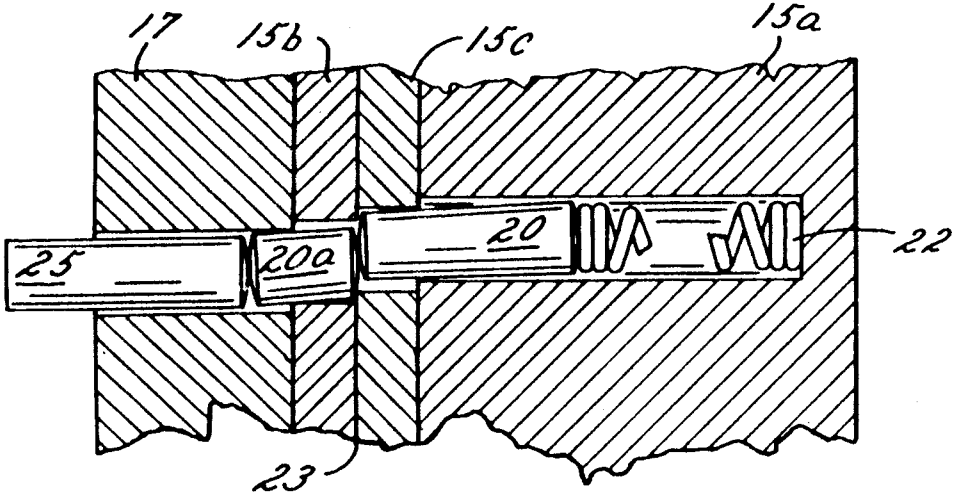
FIG. 9 is an enlarged cross-sectional view illustrating the disposition of a plurality of segmented pins and possible plate movements according to this invention.

An additional feature of the invention that contributes to its resistance to picking attempts is illustrated in FIG. 9. FIG. 9 shows what might occur with a picking attempt where a torque is applied on the spindle and the driver pin sleeve 17 causes a shift slightly in the downward direction as viewed in the figure. The respective plates 15b, 15c, having independent limited rotational capability free of the fixed sleeve 15a as well as one another, cause either a pin column lockup preventing further manipulation or a false feel of a shear plane, which is not a true shear plane. This shifting or staggering of the respective limitedly rotatable plates 15*b*, 15*c* will also impact other pin columns by way of shutting them out from being capable of manipulation with a pick.

Figure 11:
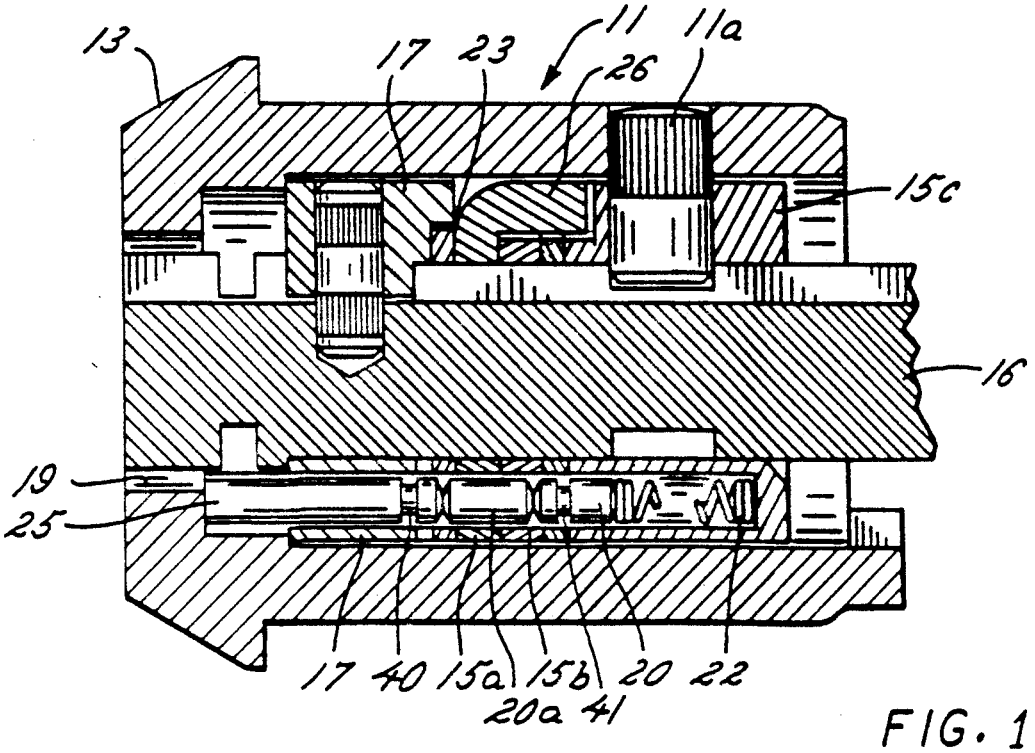
FIG. 11 is a cross-sectional view of the assembled embodiment of FIG. 10.
Figure 10:
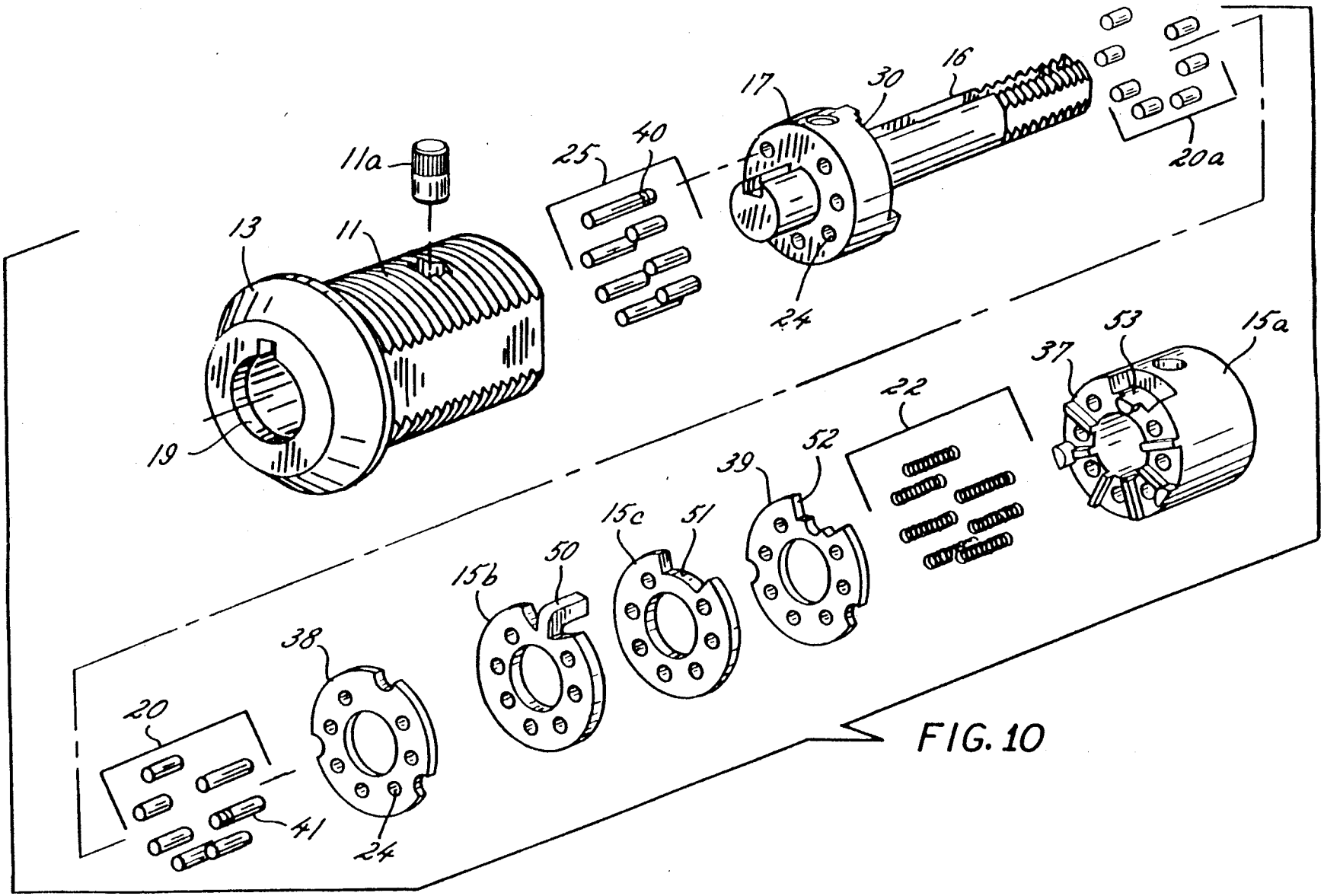
FIG. 10 is an exploded perspective view of an alternative embodiment of the invention.

Turning to FIGS. 10 and 11, n alternative embodiment the invention of FIGS. 1 to 5 is incorporated with the construction of Johnson U.S. Pat. No. 4,802,354. In the Johnson construction, at least one of either the rear face of the driver sleeve 17, or the front face of the tumbler sleeve 15*a* are provided with undercuts formed by providing notch portions 36, 37 on each side of the driver and tumbler axial bores. The edges of the trough of the notch 36, 37 give the feel of a plate interface or a shear plane as a picker manipulates the pin segments 25, 20*a*, 20. The notch crest portions of the tumbler and driver sleeve 17, 15*a* support matching discs 38, 39, the interface of which forms the true shear plane if a lock provides no limitedly rotatable plates 15*b*, 15*c*. The underside of each disc 38, 39 that is adjacent the notches 36, 37 likewise provides edges that may result in the feel of a shear plane. When attempting to pick the lock, if a picker aligns the driver 25 and tumbler pins 20 at any of these edges, the spindle 17 and driver sleeves 15*a* will not be able to turn because the pins 25, 20 will be caught at an edge in the trough of the notch 36, 37 or on an edge at the underside of a disc 38, 39.

Referring now to the embodiment shown in FIGS. 10 and 11, the notches 36 are provided on the rear face of the driver pin sleeve 17, and notches 37 are provided on the front face of the tumbler sleeve 15*a*The discs 38, 39 are staked to the respective driver sleeve 17 and forward end of the tumbler sleeve portion 15*a*. It will be appreciated that with this arrangement, when the discs 38, 39 are staked to the respective sleeves 17, 15*a* there is also provided the ability to precisely size the assembly for the pin lengths used in the lock.

When conventionally shaped driver pins and tumbler pins are used with such a notch and disc arrangement, the discontinuities or edges provide a slight displacement of a driver or tumbler pin as the pin encounters the discontinuity during its axial motion. This effectively provides the false feel of an interface or shear plane to a person attempting to pick the lock. This false feel effect is further accentuated, by providing annular grooves on at least certain ones the driver and tumbler pins. More specifically, in the embodiment shown in FIG. 10, the driver pin 25 is provided with an annular groove 40 proximate to its end that cooperates with the tumbler pin 20. In addition, the tumbler pin 20 is also provided with a similar annular groove 41 on its end cooperating with the driver pin 25. As the driver pin 25 is moved axially inwards so as to push the tumbler pin 20 inwards against the pre-tensioning effect of the compression spring 22, the annular grooves 40 and 41 cooperate with the driver notches 36, 37 so as to increase the extent of "give" between the pins 25, 20*a*, 20 and the bore discontinuity presented by the notches 36, 37, thereby giving the false impression that an interface or shear plane 23 exists in the vicinity of the trough of the notch 36, 37. As the inward displacement of the driver pin 25 and tumbler pin 20 continues, the pin grooves 40 and 41 traverse the true shear plane 23 and subsequently interact with the tumbler notches to again increase the extent of "give" so as to provide a second false impression that an interface or shear plane 23 lies in the vicinity of the notches 36, 37.

The annular grooves may be provided on several of the driver pins 25, intermediate pins 20*a*, or tumbler pins 20. The different lengths of the driver pins used to code the lock, in effect, cause grooves on the driver and tumbler pins to co-act with the notches on the driver and the tumbler sleeve in such a manner that the false feel of the interface or shear plane is provided at different inwardly extending positions of the driver and tumbler pins 25, 20*a*, 20, thereby making it substantially impossible to determine exactly the true position of the shear plane.

The resistance of the Johnson lock to picking attempts is accentuated further by the incorporation of the limitedly rotatable plates 15*b*, 15*c*, as shown in FIGS. 10 and 11, which create actual false shear planes between the interface of the plates 15*b*, 15*c*, and interface between the plate 15*c* and the tumbler sleeve 15*a*. As described in connection with the embodiment shown in FIGS. 1–5, the discs 15*b*, 15*c* may rotate up to approximately one-half of the arcuate distance between the centers of the bore holes 21 when the pin 25, 20*a*, 20 interfaces are aligned with the false shear planes identified above.

Although the embodiment shown in FIGS. 10 and 11 is similar to the embodiment shown in FIGS. 1–5, the segmented tumbler sleeve of this embodiment includes the stationary tumbler sleeve 15*a* and disc 39 stacked thereto, as well as the limitedly rotatable plates 15*b*, 15*c*. The segmented tumbler sleeve is mounted so that it is independently rotatable at the shear line 23 with respect to the driver pin sleeve 17 and the disc 38 stacked thereto. The plates 15*b*, 15*c* are mounted such that they are limitedly rotatable between themselves and the stationary tumbler sleeve 15*a* and associated disc 39.

In this embodiment, the degree to which the plates 15*b*, 15*c* are permitted to rotate is limited by a bent-over leg portion 50 that extends rearward from the forwardmost plate 15*b* through notches 51, 52, 53 in the other plate 15*c*, the stationary disc 39, and the stationary tumbler sleeve 15*a*, respectively. The notches 51, 52, 53 are wider than the bent-over leg 50 so that the discs 15*b*, 15*c* may rotate through an arc limited by the leg 50 and notches 51, 52, 53.

The above type of lock construction incorporating limitedly rotatable plates and notches for the driver and tumbler sleeves provides a substantially "pick proof" lock. Further, the components of the lock are easily and economically manufactured. For example, the discs and limitedly rotatable plates may be stamped or die cut. Additionally, the sleeve notches provide a simple and economical alternative to the expensive and possibly unfeasible molding or boring operations that would otherwise be necessary to define an annular undercut inside an integrally formed tumbler sleeve that would provide a false feel.

It will be apparent that varying combinations of grooved and ungrooved driver and tumbler pins as well as limitedly rotatable plates may be provided to present the false feel of the shear plane and actual false shear planes in a manner that appears seemingly random to a person attempting to pick or decode the lock.

It will be appreciated by those skilled in the art of locks that the present invention may also incorporate a system for master keying axial pin tumbler locks as disclosed in Falk U.S. Pat. No. 3,738,136, which further increases its versatility.

From the foregoing it is quite apparent that the present invention provides an improved tumbler lock construction which is highly resistant to picking attempts and is based on an uncomplicated locking mechanism which can be economically manufactured.

What is claimed is:

1. In a tubular lock construction comprising an outer barrel having fore and rear ends, a tumbler sleeve including a stationary portion telescoped into the rear end portion of the barrel, a locking spindle extending through and rotatably mounted in the stationary tumbler sleeve portion, a rotatable driver sleeve fixed to the spindle and disposed within the barrel adjacent to the fore end of the tumbler sleeve, sets of driver and tumbler pins slidably mounted in axially extending and annularly spaced bores defined in the stationary tumbler sleeve portion and the driver sleeve, the improvement comprising:

a plurality of tumbler plates disposed between the driver sleeve and the stationary sleeve portion, each of the plates having annularly spaced bores corresponding to the bores of the driver sleeve and stationary tumbler portion sleeve, at least one of the sets of driver and tumbler pins further comprising at least one intermediate pin segment slidably mounted between the driver pin and the tumbler pin in an aligned set of axial bores, the combined length of the intermediate pin segments within each bore being less than the combined thickness of the plurality of tumbler plates, at least one of the tumbler plates having a projection and the remaining tumbler plates and the stationary tumbler sleeve having cooperating openings through which the projection extends, said openings being wider than the projection, each of said tumbler plates being mounted for individual limited rotational movement with respect to one another and the stationary tumbler sleeve portion when pin segment interfaces in each set of the bores coincide with respective sleeve and/or plate interfaces, said individual rotational movement limited by the projection and the cooperating openings, whereby a false shear plane at the coinciding interfaces is provided with sufficient rotational movement to be essentially the same in feel as a true shear plane.

2. The tubular lock construction of claim 1 wherein the projection from the plate adjacent the driver sleeve extends toward the rear end of the barrel.

3. The tubular lock construction of claim 2 wherein the projection is formed integrally with the plate.

4. The tubular lock construction of claim 1 wherein the plates are of different thicknesses.

5. The tubular lock construction of claim 2 wherein the remaining plates and the stationary tumbler sleeve have notches along the peripheries through which the projection extends.

6. The tubular lock construction of claim 1 wherein the limited rotational movement is on the order of one-half of the arcuate distance between the bores.

7. The tubular lock construction of claim 1 further comprising at least one disc member and at least one of the rear of the driver sleeve or the front of the stationary tumbler sleeve has notches, said disc member being secured to the sleeve along the notched surface.

8. The tubular lock construction of claim 7 wherein at least some of the driver and tumbler pins have annual grooves.

9. The tubular lock construction of claim 7 wherein at least one axial bore of the notched sleeve is surrounded by a notch trough.

10. The tubular lock construction of claim 7 wherein each axial bore has a notch crest between it and the next axial bore.

11. In a tubular lock construction comprising an outer barrel having fore and rear ends, a tumbler sleeve including a stationary portion telescoped into the rear end portion of the barrel, a locking spindle extending through and rotatably mounted in the stationary tumbler sleeve portion, a rotatable driver sleeve fixed to the spindle and disposed within the barrel adjacent to the fore end of the tumbler sleeve, sets of driver and tumbler pins slidably mounted in axially extending and annularly spaced bores defined in the stationary tumbler sleeve portion and the driver sleeve, the improvement comprising:

a plurality of tumbler plates disposed between the driver sleeve and the stationary sleeve portion, each of the tumbler plates being mounted for individual rotational movement with respect to one another and the stationary tumbler sleeve portion , each of the plates having annularly spaced bores corresponding to the bores of the driver sleeve and stationary tumbler portion sleeve, at least one of the sets of driver and tumbler pins further comprising at least one intermediate pin segment slidably mounted between the driver pin and the tumbler pin in an aligned set of axial bores, the combined length of the intermediate pin segments within each bore being less than the combined thickness of the plurality of tumbler plates, the pin segments permitting relative rotational movement of at least one of the tumbler plates when pin segment interfaces in each set of the bores coincide with respective sleeve and/or plate interfaces, said stationary tumbler sleeve having a projection and the tumbler plates having cooperating openings through which the projection extends, said openings being wider than the projection, the projection and the cooperating openings limiting the relative rotational movement of the plates when the pin segment interfaces in each set of the bores coincide with respective sleeve and/or plate interfaces, the projection and cooperating openings permitting sufficient relative rotational movement to create a false shear plane at the coinciding interfaces to provide essentially the same feel as a true shear plane.

12. The tubular lock construction of claim 11 wherein the projection is a post that is secured to the stationary tumbler sleeve and extends toward the fore end of the lock.

13. The tubular lock construction of claim 12 wherein at least one of the plates has a notch along its periphery through which the post extends.

14. The tubular lock construction of claim 11 further comprising at least one disc member, and at least one of the rear of the driver sleeve or the front of the stationary tumbler sleeve has notches, said disc member being secured at the sleeve along the notched surface.

15. The tubular lock construction of claim 14 wherein at least some of the driver and tumbler pins have annular grooves.

16. In a tubular lock construction comprising an outer barrel having fore and rear ends, a tumbler sleeve including a stationary portion telescoped into the rear end portion of the barrel, a locking spindle extending through and rotatably mounted in the stationary tumbler sleeve portion, a rotatable driver sleeve fixed to the spindle and disposed within the barrel adjacent to the fore end of the tumbler sleeve, sets of driver and tumbler pins slidably mounted in axially extending and annularly spaced bores defined in the stationary tumbler sleeve portion and the driver sleeve, the improvement comprising:

a plurality of tumbler plates of different widths disposed between the driver sleeve and the stationary sleeve portion, each of the plates having annularly spaced bores corresponding to the bores of the driver sleeve and stationary tumbler portion sleeve, at least one of the sets of driver and tumbler pins further comprising at least one intermediate pin segment slidably mounted between the driver pin and the tumbler pin in an aligned set of axial bores, the combined length of the intermediate pin segments within each bore being less than the combined thickness of the plurality of tumbler plates, said stationary tumbler sleeve having a projection and the tumbler plates having cooperating openings through which the projection extends, said openings being wider than the projection, each of said tumbler plates being mounted for individual limited rotational movement with respect to one another and the stationary tumbler sleeve portion when pin segment interfaces in each set of the bores coincide with respective sleeve and/or plate interfaces, said individual rotational movement limited by the projection and the cooperating openings, whereby a false shear plane at the coinciding interfaces is provided with sufficient rotational movement to be essentially the same in feel as a true shear plane.

17. In a tubular lock construction comprising an outer barrel having fore and rear ends, a tumbler sleeve including a stationary portion telescoped into the rear end portion of the barrel, a locking spindle extending through and rotatably mounted in the stationary tumbler sleeve portion, a rotatable driver sleeve fixed to the spindle and disposed within the barrel adjacent to the fore end of the tumbler sleeve, sets of driver and tumbler pins slidably mounted in axially extending and annularly spaced bores defined in the stationary tumbler sleeve portion and the driver sleeve, the improvement comprising:

a plurality of tumbler plates disposed between the driver sleeve and the stationary sleeve portion, each of the plates having annularly spaced bores corresponding to the bores of the driver sleeve and stationary tumbler portion sleeve, at least one of the sets of driver and tumbler pins further comprising at least one intermediate pin segment slidably mounted between the driver pin and the tumbler pin in an aligned set of axial bores, the combined length of the intermediate pin segments within each bore being less than the combined thickness of the plurality of tumbler plates, a post secured to the stationary tumbler sleeve extending toward the fore end of the lock, cooperating openings in the tumbler plates, the post extending through the openings, the openings being wider than the post, the opening in at least one of the plates being an elongated bore, each of said tumbler plates being mounted for individual limited rotational movement with respect to one another and the stationary tumbler sleeve portion when pin segment interfaces in each set of the bores coincide with respective sleeve and/or plate interfaces, said individual rotational movement limited by the post and the cooperating openings, whereby a false shear plane at the coinciding interfaces is provided with sufficient rotational movement to be essentially the same in feel as a true shear plane.

18. In a tubular lock construction comprising an outer barrel having fore and rear ends, a tumbler sleeve including a stationary portion telescoped into the rear end portion of the barrel, a locking spindle extending through and rotatably mounted in the stationary tumbler sleeve portion, a rotatable driver sleeve fixed to the spindle and disposed within the barrel adjacent to the fore end of the tumbler sleeve, sets of driver and tumbler pins slidably mounted in axially extending and annularly spaced bores defined in the stationary tumbler sleeve portion and the driver sleeve, the improvement comprising:

a plurality of tumbler plates disposed between the driver sleeve and the stationary sleeve portion, each of the plates having annularly spaced bores corresponding to the bores of the driver sleeve and stationary tumbler portion sleeve, at least one of the sets of driver and tumbler pins further comprising at least one intermediate pin segment slidably mounted between the driver pin and the tumbler pin in an aligned set of axial bores, the combined length of the intermediate pin segments within each bore being less than the combined thickness of the plurality of tumbler plates, said stationary tumbler sleeve having a projection and the tumbler plates having cooperating openings through which the projection extends, said openings being wider than the projection, each of said tumbler plates being mounted for individual limited rotational movement with respect to one another and the stationary tumbler sleeve portion when pin segment interfaces in each set of the bores coincide with respective sleeve and/or plate interfaces, said individual rotational movement limited by the projection and the cooperating openings, the limited rotational movement being on the order of one-half of the arcuate distance between the bores, whereby a false shear plane at the coinciding interfaces is provided with sufficient rotational movement to be essentially the same in feel as a true shear plane.

19. In a tubular lock construction comprising an outer barrel having fore and rear ends, a tumbler sleeve including a stationary portion telescoped into the rear end portion of the barrel, a locking spindle extending through and rotatably mounted in the stationary tumbler sleeve portion, a rotatable driver sleeve fixed to the spindle and disposed within the barrel adjacent to the fore end of the tumbler sleeve, sets of driver and tumbler pins slidably mounted in axially extending and annularly spaced bores defined in the stationary tumbler sleeve portion and the driver sleeve, the improvement comprising:

a plurality of tumbler plates disposed between the driver sleeve and the stationary sleeve portion, each of the plates having annularly spaced bores corresponding to the bores of the driver sleeve and stationary tumbler portion sleeve, at least one disc member, at least one of the rear of the driver sleeve or the front of the stationary tumbler sleeve having notches, said disc member being secured at the sleeve along the notched surface, at least one axial bore of the notched sleeve being surrounded by a notch trough, at least one of the sets of driver and tumbler pins further comprising at least one intermediate pin segment slidably mounted between the driver pin and the tumbler pin in an aligned set of axial bores, the combined length of the intermediate pin segments within each bore being less than the combined thickness of the plurality of tumbler plates, said stationary tumbler sleeve having a projection and the tumbler plates having cooperating openings through which the projection extends, said openings being wider than the projection, each of said tumbler plates being mounted for individual limited rotational movement with respect to one another and the stationary tumbler sleeve portion when pin segment interfaces in each set of the bores coincide with respective sleeve and/or plate interfaces, said individual rotational movement limited by the projection and the cooperating openings, whereby a false shear plane at the coinciding interfaces is provided with sufficient rotational movement to be essentially the same in feel as a true shear plane.

20. In a tubular lock construction comprising an outer barrel having fore and rear ends, a tumbler sleeve including a stationary portion telescoped into the rear end portion of the barrel, a locking spindle extending through and rotatably mounted in the stationary tumbler sleeve portion, a rotatable driver sleeve fixed to the spindle and disposed within the barrel adjacent to the fore end of the tumbler sleeve, sets of driver and tumbler pins slidably mounted in axially extending and annularly spaced bores defined in the stationary tumbler sleeve portion and the driver sleeve, the improvement comprising:

a plurality of tumbler plates disposed between the driver sleeve and the stationary sleeve portion, each of the plates having annularly spaced bores corresponding to the bores of the driver sleeve and stationary tumbler portion sleeve, at least one disc member, at least one of the rear of driver sleeve or the front of the stationary tumbler sleeve having notches, said disc member being secured at the sleeve along the notched surface, each axial bore having a notch crest between it and the next axial bore, at least one of the sets of driver and tumbler pins further comprising at least one intermediate pin segment slidably mounted between the driver pin and the tumbler pin in an aligned set of axial bores, the combined length of the intermediate pin segments within each bore being less than the combined thickness of the plurality of tumbler plates, said stationary tumbler sleeve having a projection and the tumbler plates having cooperating openings through which the projection extends, said openings being wider than the projection, each of said tumbler plates being mounted for individual limited rotational movement with respect to one another and the stationary tumbler sleeve portion when pin segment interfaces in each set of the bores coincide with respective sleeve and/or plate interfaces, said individual rotational movement limited by the projection and the cooperating openings, whereby a false shear plane at the coinciding interfaces is provided with sufficient rotational movement to be essentially the same in feel as a true shear plane.

* * * * *